US006810535B1

(12) United States Patent
Moloney

(10) Patent No.: US 6,810,535 B1
(45) Date of Patent: Nov. 2, 2004

(54) HELMET RESTRAINT SYSTEM

(75) Inventor: John Moloney, Statesville, NC (US)

(73) Assignee: Speed Solutions, Inc., Statesville, NC (US)

( * ) Notice: Subject to any disclaimer, the term of this patent is extended or adjusted under 35 U.S.C. 154(b) by 0 days.

(21) Appl. No.: 10/174,702

(22) Filed: Jun. 19, 2002

(51) Int. Cl.[7] ..... A42B 3/00
(52) U.S. Cl. ..... 2/411; 2/425; 2/468
(58) Field of Search ..... 2/421, 468, 425, 2/416, 415, 411, 6.1, 6.2; 244/122 AG; 280/290, 801.1; 297/464

(56) References Cited

U.S. PATENT DOCUMENTS

| | | | | |
|---|---|---|---|---|
| 602,609 | A | 8/1898 | Tatro | |
| 1,144,150 | A | 6/1915 | Marcovsky | |
| 3,074,669 | A | 1/1963 | Boblin | |
| 3,099,261 | A | 7/1963 | Doss et al. | |
| 3,134,106 | A | 5/1964 | Shaffer et al. | |
| 3,148,375 | A | 9/1964 | Jones | |
| 3,278,230 | A | 10/1966 | Boyce et al. | |
| 3,329,464 | A | 7/1967 | Barwood et al. | |
| 3,499,681 | A | 3/1970 | Benitez et al. | |
| 3,671,974 | A | 6/1972 | Sims | |
| 3,818,509 | A | 6/1974 | Ramo et al. | |
| 3,873,996 | A | 4/1975 | Varteressian | |
| 3,900,896 | A | 8/1975 | Ackerman | |
| 3,925,822 | A | 12/1975 | Sawyer | |
| 4,219,193 | A | 8/1980 | Newman | |
| 4,319,362 | A | 3/1982 | Ettinger | |
| 4,477,041 | A * | 10/1984 | Dunne | 244/122 AG |
| 4,638,510 | A | 1/1987 | Hubbard | |
| 4,909,459 | A | 3/1990 | Patterson | |
| 4,923,147 | A | 5/1990 | Adams et al. | |
| 4,967,985 | A * | 11/1990 | Deakin | 244/122 AG |
| 5,267,708 | A | 12/1993 | Monson et al. | |
| 5,272,770 | A | 12/1993 | Allen et al. | |
| 5,437,613 | A | 8/1995 | Reggio et al. | |
| 6,009,566 | A | 1/2000 | Hubbard | |
| 6,330,722 | B1 | 12/2001 | Betts | |
| 6,381,758 | B1 * | 5/2002 | Roberts et al. | 2/421 |
| 2001/0002087 | A1 | 5/2001 | Townsend | |

FOREIGN PATENT DOCUMENTS

| | | | | |
|---|---|---|---|---|
| JP | 08072669 A | * | 3/1996 | B60R/22/12 |
| WO | WO 93/05986 | | 4/1993 | |

* cited by examiner

*Primary Examiner*—Rodney M. Lindsey
(74) *Attorney, Agent, or Firm*—Miller, Everman & Bernard, PLLC; Gregory R. Everman

(57) ABSTRACT

A helmet restraint device for operationally securing a helmet worn by a driver, pilot, or occupant of a high-performance vehicle (such as a racecar, aircraft, or boat) to the vehicle's seat belt assembly. The helmet restraint device reduces potentially injurious forces to the occupant's head and neck during high-deceleration of the vehicle, particularly a frontal collision. The helmet restraint device includes a high strength, lightweight rod disposed behind and below the occupant's neck, just beneath the shoulder harness, and a strap that attaches between the occupant's helmet and the rod. The strap is connected to the helmet via attachments in the helmet and a cable assembly so as to allow the occupant's head to move freely from side to side. The length of the rod is sufficient to be held underneath the shoulder harness, has limited thickness to minimize interference with the occupant, yet is sufficient in size and strength to handle deceleration loads applied by the strap and shoulder harness. The strap elongates a controlled amount as the deceleration forces on the helmet, head, and neck increase, thereby allowing for controlled restraint of the occupant's head and neck. The elongation rate of the strap is tailored via the strap material's composition, weave and density.

20 Claims, 4 Drawing Sheets

HELMET RESTRAINT SYSTEM

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION (1) Field of the Invention

The present invention relates to the art of safety restraint devices for the head and neck of an occupant of a vehicle, and more particularly to a restraint device for controlling and limiting the forward and downward movement of the occupant's head when the vehicle is subjected to deceleration forces, and a method of restraining such occupant's head.

(2) Description of Related Art

An occupant of a high performance car, truck, plane, or boat (hereinafter referred to collectively as "vehicle") commonly wears a helmet for protection from head injury and also wears a shoulder harness which restrains torso movements relative to the seat and vehicle. When the vehicle undergoes deceleration either in normal operation or in a crash, the torso of the occupant is restrained by the seat and harness, to move with the vehicle, but the helmeted head is commonly unrestrained except by contact with portions of the vehicle or seat. Thus, loads which constrain the head to move with the torso are transmitted primarily through the neck. Such neck loads lead to fatigue of the operator during normal vehicle operation and to injury in a vehicle crash.

The related art has shown various types of head support devices for use for occupants of a vehicle. Illustrative are U.S. Pat. No. 3,278,230 to Boyce et al; U.S. Pat. No. 3,900,896 to Ackerman; U.S. Pat. No. 3,873,996 to Varteressian; U.S. Pat. No. 3,925,822 to Sawyer; U.S. Pat. No. 3,818,509 to Romo et al; U.S. Pat. No. 3,499,681 to Benitez et al; U.S. Pat. No. 3,134,106 to Shaffer et al; U.S. Pat. No. 4,638,510 to Hubbard; U.S. Pat. No. 4,909,459 to Patterson; U.S. Pat. No. 4,923,147 to Adams et al; U.S. Pat. No. 5,267,708 to Monson et al.; U.S. Pat. No. 5,272,770 to Allen et al; U.S. Pat. No. 6,330,722 to Betts; U.S. Pat. No. 6,009,566 to Hubbard; and U.S. Patent Application Publication No. 2001/0002087 to Townsend.

U.S. Pat. No. 3,278,230 to Boyce et al describes a shell and frame which is individually fitted and worn on the torso of an astronaut or a crew member of a high performance aircraft. This shell and frame serve as the seat back once it is secured into the aircraft by means of pins. A headrest is mounted to the frame extending upward from the torso shell to behind the head. The head is held in the headrest by a strap on each side of the helmet. The straps are retracted, when the restraint system is actuated in an emergency situation, to securely hold the head to the headrest There is no specific description given of the placement of the straps relative to the geometric configuration of the head and helmet. Except for rearward movements of the helmet which are restrained by contact with the headrest, the head and helmet are not restrained under normal vehicle operation but only by retraction of the straps on the reels which must be actuated for system operation.

U.S. Pat. No. 3,900,896 to Ackerman describes a bar which attaches to the rear of a football helmet and extends downward to fit into a cylindrical guide attached to the shoulder pads. This device would allow only movements of the helmet relative to the shoulder pads which are vertical along the axis of the bar and rotational about the axis of the bar; other motions are restrained by the device. The restrained motions are needed for athletic performance or vehicle operation and the motions not restrained by the device could result in potentially fatiguing or injurious loading in the neck.

U.S. Pat. No. 3,873,996 to Varteressian describes a device (similar to that described in U.S. Pat. No. 3,900,896 to Ackerman above) which includes a bar with its upper end attached to the rear of the helmet in a track to allow vertical motion of the bar relative to the helmet within limits of the track and the lower end of the bar attached by a ball and socket to a jacket worn on the torso. Movements of the neck are restrained by the ball-and-socket at the jacket and the slider in the track at the helmet; these restrained neck motions are not those that would naturally occur and they could be irritating to the user. For example, lateral bending of the neck to the right or left must follow the combination of rotations and translations dictated by the center of ball-and-socket joint rather than the motions of the vertebral linkage. If the stops in the ball-and-socket and slider are configured correctly, this design could reduce the potential for injury at the extremes of neck motion.

U.S. Pat. No. 3,925,822 to Sawyer describes a harness with straps on the torso and connected to the helmet to prevent the helmet from leaving the head. The harness straps do not substantially restrain the forward bending of the neck and they could cause potentially injurious compressive and bending loading in the neck under extreme neck motions.

U.S. Pat. No. 3,818,509 to Romo et al describes a strap between a football helmet and shoulder pads which is similar in effect to the harness described in U.S. Pat. No. 3,925,822 to Sawyer above.

U.S. Pat. No. 3,499,681 to Benitez et al describes a device as such: "Columnar support extends upward from the back of the occupant for attachment to the crash helmet." This support is not substantively described.

U.S. Pat. No. 3,134,106 to Shaffer et al describes an attachment of a football player's helmet to the shoulder pads by pin joints on either side of the neck.

U.S. Pat. No. 4,638,510 to Hubbard describes a neck protection device that includes in combination a high collar extending over the occupant's shoulders and a set oftethers for attachment to the helmet and collar. The high collar extends upward to adjacent the center of gravity of the head and helmet which is about eye level of the occupant. This head and neck support requires that the loading from the tethers be resisted by the collar. This loading configuration required a large collar structure which often interferes with the occupant's helmet.

U.S. Pat. No. 4,909,459 to Patterson describes a head restraint device which connects the helmet of the occupant to the vehicle seat. The head restraint has a restraining strap which applies a single force to the head to restrain the head from horizontal forward motion and a strap assembly on the helmet to hold the head upright. The restraining strap pulls the head directly back near the middle of the head and helmet. The restraining strap only applies the force when the deceleration forces are above a predetermined level. The attachment of the strap to the helmet allows the helmet to rotate about a vertical axis approximately 180 degrees. The restraint can also be connected to the torso of the occupant to simultaneously retract the head and the torso. The restraint must be detached for the occupant to exit the vehicle.

U.S. Pat. No. 4,923,147 to Adams et al describes a seat insert for a vehicle which maintains an occupant of the vehicle in a forward position during high G acceleration. The seat insert has a head support member for supporting the occupant's head during a forward, leaning posture. A head support member restraint cord is provided to restrain the movement of the head support member during an occupant's forward lean. The top and bottom of the helmet are restrained to the head support member which is behind and above the top of the helmet. The head support member tends to resist motions of the occupants head which are downward due to accelerations. The seat insert also includes a back plate assembly connected to the head support member for supporting the spine in its natural curvature. The back plate assembly is able to pivot forward relative to the seat of the vehicle. The seat insert is able to transfer G-induced weight from the spine to the back plate assembly and ultimately to the existing seat of the vehicle. The seat insert restrains the occupant relative to the seat and must rely on restraint of the torso to be compatible with the head restraint for restraining the head relative to the torso.

U.S. Pat. No. 5,267,708 to Monson et al describes a head support apparatus which can be attached to a body support device. The apparatus includes a beam housing attachable to the body support device such as to be rigid in the y-z plane but to be rotatable about an x-axis. The x-axis is defined as extending through the subject's face to the back of the head. The y-axis is defined as extending laterally from ear to ear and the z-axis is defined as extending vertically from the top of the head through the subject's chin. A U-shaped rigid beam is mountable in a channel of the beam housing such that the beam is rigidly supported within the x-y plane but is able to be rotated about the x-axis. Helmet attachments are provided for supporting the helmet relative to the rigid beam within the x-z plane but allowing rotation of the helmet about the y-axis.

U.S. Pat. No. 5,272,770 to Allen et al describes a helmet having a chin protector formed thereon, a keeper plate overlaying the shoulders, upper chest, including the sternum area, and upper back of driver, a plurality of straps connecting to the shoulder, chest and back portion of the keeper plate to aligned portions of the helmet and a pair of shoulder straps securing the keeper plate to &Le driver.

U.S. Pat. No. 6,330,722 to Betts describes a head and neck stabilizing system includes two end connectors that are separately attachable to the shoulder belt system or the suit worn by the occupant on opposite sides of the helmet. The two end belts each have one end affixed to one end connector and an opposite end connected to one buckle, respectively.

U.S. Pat. No. 6,009,566 to Hubbard is an improvement on the neck protection device previously described in U.S. Pat. No. 4,638,510 but still incorporates the use of a collar that fits around the occupant's shoulders, adjacent the neck, and on front of the occupant's chest. The device is known as the HANS device and uses a high collar around the back of the driver's head attached to the driver's shoulder safety harness. The helmet is attached to this collar by two straps. Because of its bulkiness, the HANS system makes it more difficult for the race car driver to climb in and out of stock and race cars, and the device does not work well in some supine seating positions. Different size HANS harnesses may be required for different size drivers and/or cockpits. Many drivers refuse to wear the device because it is bulky, uncomfortable and restricts head movement during driving.

U.S. Pat. Application Publication No. 2001/0002087 to Townsend describes a helmet restraint system that secures the helmet of a driver or passenger occupant of a vehicle, such as a race car, to the structural chassis, body, or frame of the vehicle, independent of the shoulder harness or seatbelt.

Other U.S. patents more distantly related to the present invention include U.S. Pat. No. 1,144,150 to Marcousky; U.S. Pat. No. 3,074,669 to Bohlin; U.S. Pat. No. 3,099,261 to Doss et al; U.S. Pat. No. 3,148,375 to Jones; U.S. Pat. No. 3,329,464 to Barwood et al; U.S. Pat. No. 3,671,974 to Sims; U.S. Pat. No. 3,925,822 to Sawyer; U.S. Pat. No. 4,219,193 to Newman; U.S. Pat. No. 4,319,362 to Ettinger; U.S. Pat. No. 5,437,613 to Reggio et al; U.S. Pat No. 602,609 to Tatro; and WO 93/05986 to Jeong.

There remains the need for an economical helmet restraint system which is easily mounted and directly attached to the occupant and can easily exit with the occupant from the vehicle in the event of an emergency egress situation, such as fire. The present invention does not require the implementation of a quick release latch or latches to release and free the driver from the helmet restraint as is required with the Head and Neck Support (HANS) device (U.S. Pat. No. 6,009,566), and other current helmet restraint systems. However, a quick release latch could be incorporated into the helmet restraint system. The occupant or rescue personnel can simply unlatch the safety harness or shoulder belt system, lean the occupant forward to pull the high-strength and lightweight rod out from under the shoulder harness or belt system, and the occupant can exit the vehicle. This invention is very small and unobtrusive in comparison to some of the prior art, especially the HANS device, which also improves the emergency egress of the occupant trying to exit through a window opening. The compactness and lightweight features of the invention does not interfere with the occupant's mobility, and thus allows the occupant to wear the helmet restraint system while entering and exiting most vehicles. Other prior art devices must be installed once the occupant is in the vehicle or seat and removed prior to the occupant exiting the vehicle. The invention allows the occupant to easily remove the helmet restraint device while in the vehicle and then replace when needed as opposed to prior art that prohibits the occupant from removing and replacing the device while in the vehicle. The invention allows the occupant to comfortably and freely move their head from side to side via the cable assembly and belt systems without the inherent distraction and discomfort of a restrictive collar over the shoulder or helmet restraint interaction with the seating system. Some of the prior art can cause discomfort and tissue injury when worn for long periods of time.

Thus, the prior art does contain descriptions of related devices with some of the elements of the present invention including straps to restrain helmet motions and supports between helmet and shoulder harness. These prior devices are intended to protect the neck from injury; however, in their different configurations, they can cause compression on the neck and therefore increase the potential for neck and head injury. Furthermore, the prior art does not address the problems of emergency egress from the vehicle, driver comfort, the ease of which the occupant can remove and replace the helmet restraint system, and protection of the back of the head during the rebound phase of a crash event.

SUMMARY OF THE INVENTION

The present invention is directed towards a helmet restraint device for operationally joining a helmet worn by an occupant of a high-performance vehicle to the vehicle's seat belt assembly. The helmet restraint device reduces potentially injurious forces to the occupant's head and neck during high-deceleration of a vehicle, particularly a frontal collision. In particular, the helmet restraint device controls and limits forward and downward movement of the occupant's head when subjected to the deceleration forces. The helmet restraint device is not fixably secured to the vehicle, is small and unobtrusive, and accordingly does not interfere with the occupant's operation of the vehicle. Importantly, the helmet restraint device also does not impede the occupant's egress from the vehicle, which is particularly important during an emergency situation.

In the broadest sense, the present invention is directed towards a helmet restraint apparatus for restraining the forward and downward movement of an occupant's helmet and head during the deceleration of a vehicle. The helmet restraint apparatus comprises a helmet restraint device attached to the helmet. A portion of the helmet restraint device is disposed beneath the shoulder belts of the vehicle which serves to anchor the restraint device. The restraint device is moveable relative to the shoulder belts and loads against the shoulder belts during deceleration of the vehicle. Preferably, the restraint apparatus can include a flexible member having first and second sections. An attachment member is attached to the helmet and also to the first section of the flexible member. A rigid member is attached to the second section of the flexible member and is disposed beneath the shoulder belts. As a further option, fire retardant cloth can be attached to the helmet restraint device to protect the neck of the occupant.

In the broadest sense, the present invention also is directed towards a helmet restraint apparatus having means for loading the restraint device against shoulder belts of the vehicle and means for attaching the helmet restraint device to the helmet.

The present invention is also directed towards a method for restraining the downward and forward motions of the occupant's head and neck during deceleration of the vehicle comprising the steps of providing a helmet restraint device, then moving the helmet restraint device relative to shoulder belts of the vehicle when the vehicle is subjected to deceleration, loading the helmet restraint device against the shoulder belts, and placing the helmet restraint device in tension. These steps result in restraining the forward and downward movement of the occupant's head and helmet. Preferably, the steps can further include causing a resultant force vector (V) to pass through the forehead region of the helmet when the helmet restraint device is put into tension.

OBJECTS OF THE INVENTION

The principal object of the present invention is to provide a device for resisting the forward and downward motion of an occupant's head and helmet worn thereon while in a vehicle during a high deceleration event, particularly a frontal collision.

Another object of the invention is to provide a helmet restraint device that is small and unintrusive which does not interfere with or cause discomfort to the occupant while operating the vehicle.

A further object of this invention is to provide a helmet restraint device that is not affixed to a vehicle so that the occupant can quickly egress the vehicle.

Another further object of the invention is to provide a helmet restraint device that is simple in configuration and use while effectively preventing potentially injurious load on an occupant's neck during a collision event.

Another object of the invention is to provide a helmet restraint device that is inexpensive and doesn't require modification of the vehicle.

Another object of the invention is to provide a method of restraining forward and downward motion of an occupant's head and helmet while in a vehicle during a high deceleration event.

DETAILED DESCRIPTION

The invented helmet restraint device operationally attaches a helmet worn by a driver, pilot, or passenger occupant of a high-performance vehicle (such as a race car, aircraft, or boat) to the vehicle's seatbelt assembly. The helmet restraint device reduces potentially injurious forces to the occupant's head and neck during high-deceleration of the vehicle, particularly a frontal collision. In particular, the helmet restraint device controls and limits forward and downward movement of the occupant's head when subjected to deceleration forces.

Figure 1:
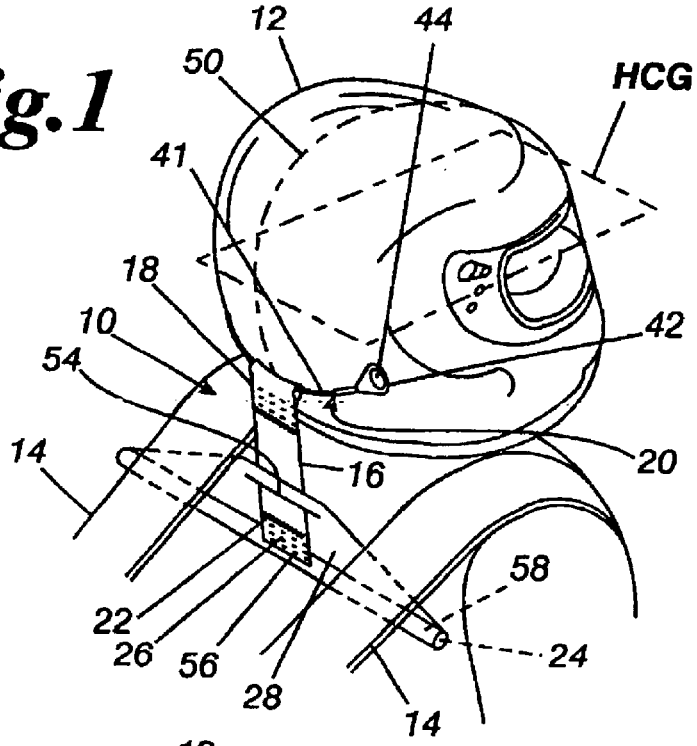
FIG. 1 is a perspective view of the invented helmet restraint device attached to an occupant's helmet and in position beneath a vehicle's shoulder harness.
Figure 2:
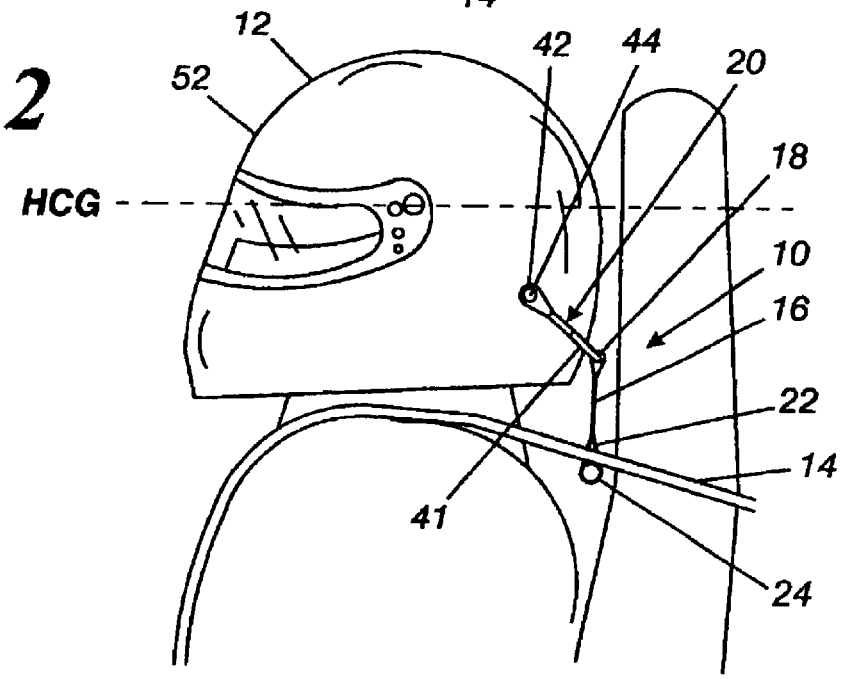
FIG. 2 is a side view of the helmet restraint device of FIG. 1.

Referring now to the drawings, and particularly to FIGS. 1 and 2, the helmet restraint device 10 functionally joins the occupant's helmet 12 to the vehicle's seat belt shoulder harness 14 for transferring forces from the helmet 12 through the restraint device 10 to the shoulder harness 14. The restraint device 10 comprises a flexible member, such as a strap 16, cable, belt, or the like, having a first section 18 for slidably retaining a cable assembly 20 which is fixably attached to the helmet shell 12, and a second section 22 attached to an elongate, high strength, light weight rod 24 which is slidably disposed beneath the shoulder belts 14. During a deceleration event, particularly a frontal collision, the flexible strap 16 transmits forces from the occupant's helmet 12 to the rod 24 which loads against the underside of the shoulder belts 14. The shoulder belts 14 serve as an anchor, providing resistance against movement of the helmet 12. Accordingly, motions of the head relative to the torso, and associated forces transmitted to the occupant's neck, are substantially reduced thereby limiting fatigue and/or injury that may occur during a collision.

The first section 18 of the strap 16 is slidably attached to the cable assembly 20 by any suitable means. For example, the terminal end of the first strap section 18 can be folded back and stitched, bonded or fastened together to form a loop through which the cable assembly 20 is received. Although the connection between the strap 16 and cable assembly 20 can be fixed, it is preferred that they slidably communicate so that the occupant can freely move his head from side to side without unnecessary restriction from the helmet restraint device 10.

The second section 22 of the strap 16 is joined to the rod 24 by any suitable attachment means 26. The attachment means 26 preferably allows no movement, or only a limited relative movement, between the flexible strap 16 and rod 24 such that the strap 16 engages at the mid-point of the rod 24 during a frontal collision. For example, the terminal end of the second strap section 22 can be folded over and stitched, bonded, or fastened to the strap 16 to form a loop into which the rod 24 is received. Further methods of attaching the strap 16 and rod 24 together includes adhesive bonding, tieing, and providing the strap 16 with a buckle that interconnects with a mating tongue provided on the rod. As another option, the rod 24 can be enclosed in a fire retardant cloth 28 which limits lateral movement of the rod 24 with respect to the strap 16, as further described below.

The effective length of the strap 16 between the cable assembly 20 and rod 24 varies according to the height of the driver and the specific seatbelt assembly utilized. A typical effective length is approximately seven (7"), and optionally, a webbing tie (not shown) may be provided to allow length adjustments of the strap 16. The strap 16 is slightly elastic such that it elongates a controlled amount as applied deceleration forces on the helmet, head and neck increase, thereby softening the restraint of the occupant's head and neck. The elongation rate of the flexible strap 16 is tailored via the strap material composition, weave and density. The elastic characteristic of the strap 16 is insufficient to substantially contribute to a rebound effect of the helmet 12 after elongation of the strap 16.

The cable assembly 20 is preferably an elongate steel cable 41, with a smooth outer sheath, having connector tabs 42 at its opposed terminal ends. The tabs 42 provide suitable structure to facilitate attachment to the helmet 12 and are affixed to the cable 41 by compression fitting, adhesive bonding, mechanical fastener, or the like.

The cable assembly 20 is slidably received within the loop of the first strap section 18 and is fixed at the tabs 42 to the helmet shell 12 by suitable attachments 44. The attachments 44 can be rivets, threaded fasteners, locking fasteners, adhesive bonding, or the like, to strongly affix the cable assembly to the helmet such that structural integrity of the helmet/cable assembly attachments remain despite high forces applied during a collision. Another suitable attachment means includes providing enlarged terminal ends on the cable assembly, wherein the enlarged ends are inserted through openings in the helmet for securement thereto. The helmet shell 12 can be reinforced to further strengthen its connection with the cable assembly 20.

Two points of attachment between the cable assembly 20 and helmet 12 are shown in FIGS. 1 and 2. Preferably, but not to be construed as limiting, the attachments 44 are secured to the helmet shell 12 at respective locations of about three inches (3") from the bottom of the helmet 12, as arcuately measured along the shell's surface 12, and spaced in opposed directions of about four and one-quarter inches (4¼") from the longitudinal center-line 50 of the helmet 12, also measured along the shell's surface.

The cable assembly 20 has approximately one-quarter inch (4¼") clearance between the cable 41 and the surface of the helmet shell 12 to allow the strap 16 to slide therealong without substantial restriction as the driver moves his head from side to side during normal vehicle operation. The moderate amount of slack in the cable 41 causes the cable-strap interface to hang approximately two inches (2") from the bottom of the helmet 12 before tension is applied to the strap 16.

Figure 2A:
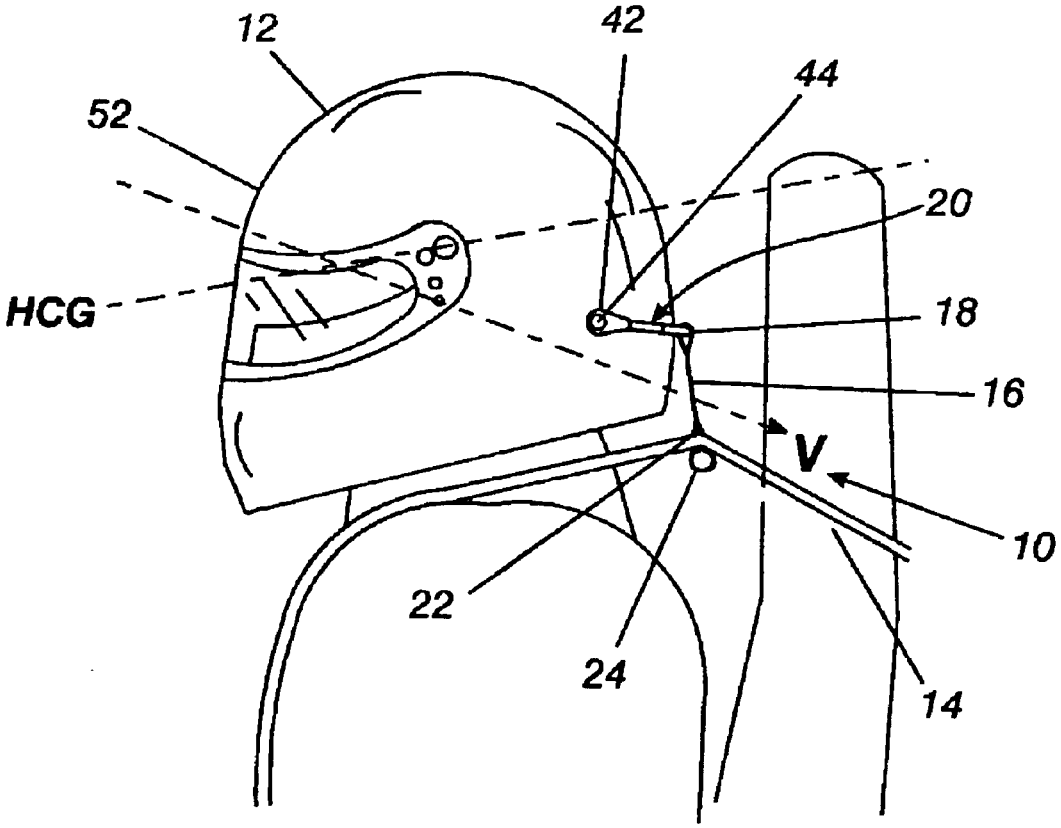
FIG. 2*a* is a side view of the helmet restraint device of FIG. 1 with the restraint device controlling the helmet and head of the driver during a deceleration event.

As illustrated in FIG. 2*a*, the orientation of the cable assembly 20 with the helmet 12, including the location of the attachments 44 therebetween, is such that while the flexible strap 16 is holding tension during a collision, the cable assembly 20 causes a resultant force vector (V) which extends through the forehead region 52 of the occupants helmet 12. The forehead region 52 of the helmet 12 reacts against the occupant's head to control rotation of the occupant's head and neck. The helmet chin strap restrains potential slippage of the occupant's head within the helmet 12. Moreover, the orientation of the cable assembly 20, strap 16, and rod 24, in combination with the chin strap, helps insure that the helmet 12 remains in proper position to protect the back of the occupant's head and upper neck during the rebound phase of a crash event by keeping the helmet 12 properly positioned on the occupant.

Referring to FIGS. 1 and 2, the lightweight, high strength rod 24 is attached to the second section 22 of the strap 16 and is disposed beneath the shoulder belts 14 behind the occupant's neck, in general alignment with the occupant's shoulders. The rod 24 is free floating beneath the shoulder belts 14 and has a sufficient length to extend and be held underneath both shoulder belts 14. Although different cross-sections may be used, the rod 24 is preferably cylindrical with a minimal diameter to obviate discomfort to the occupant, yet sufficiently strong to handle deceleration loads applied by the strap 16 and shoulder harness 14.

Since the rod 24 is not affixed to any portion of the vehicle, including the seatbelt assembly, the helmet restraint device 10 can be positioned for operation by merely having the occupant, or another person, laterally position the rod 24 beneath the shoulder belts 14. Egress from the vehicle is similarly simple by merely removing the rod 24 from beneath the shoulder belts 14. Removal can be performed while the seat belt is buckled, or automatically occurs when the seat belt assembly is necessarily unbuckled so that the occupant can exit the vehicle.

Despite that the rod 24 is free floating, it is properly held in place by the strap 16 and shoulder belts 14 when the occupant is securely belted into the vehicle. In normal operation, the strap 16 is generally vertically oriented from the rod 24 with its effective length holding the rod 24 in close contact with the underside of the shoulder belts 14. This close contact positioning between the generally vertical strap 16 and the generally horizontal shoulder belts 14, prohibits the rod 24 from moving out from under the shoulder belts 14 during a collision.

Referring to FIG. 2*a*, during a collision, the head, helmet 12, torso and rod 24 move forward relative to the vehicle. During the beginning of this forward movement phase, the rod 24 slides forwardly, carried by the strap 16, beneath the shoulder belts 14. At a point in the crash event that the head and neck begin to rotate and move ahead of the torso, the high strength, lightweight rod 24 reacts and loads against the shoulder belts 14 to restrain the motion of the head and neck. That is, the load bearing surfaces, where the rod 24 and shoulder belts 14 engage, restrict further forward and downward rotation of the head and neck.

Referring to FIG. 1, the fire retardant cloth 28 can be optionally included with the helmet restraint device 10. The fire retardant cloth 28 is generally triangular shaped to provide protection to the back of the occupants neck in the event of a fire. The cloth 28 is provided with a first slot 54 through which the strap 16 is received for holding the cloth 28 open along the back of the neck of the occupant, a second slot 56 through which the terminal end of the strap is received for holdably engaging the rod 24 by any of the previously described means, and a pouch enclosure 58 for holding the rod 24 therein. The pouch 58 restricts relative movement between the rod 24 and strap 16 and can be provided with padding to cushion the occupant from the rod 24.

Figure 3:
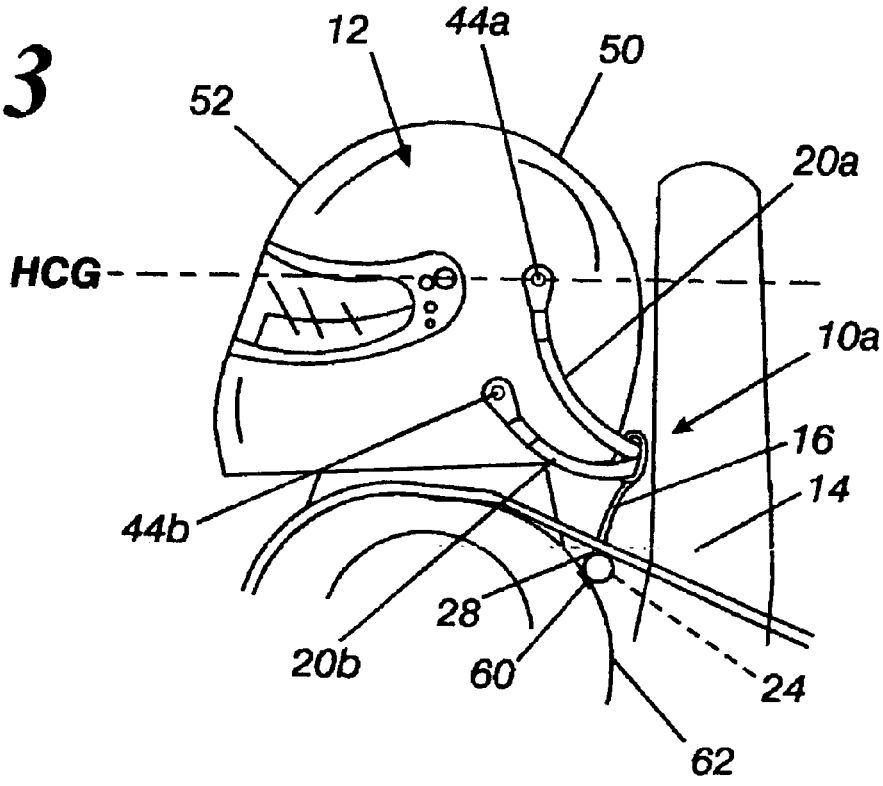
FIG. 3 is a side view of a first alternative embodiment of the helmet restraint device showing a plurality of cable assemblies attached to the helmet and the restraint device releaseably attached to a racing suit.
Figure 4:
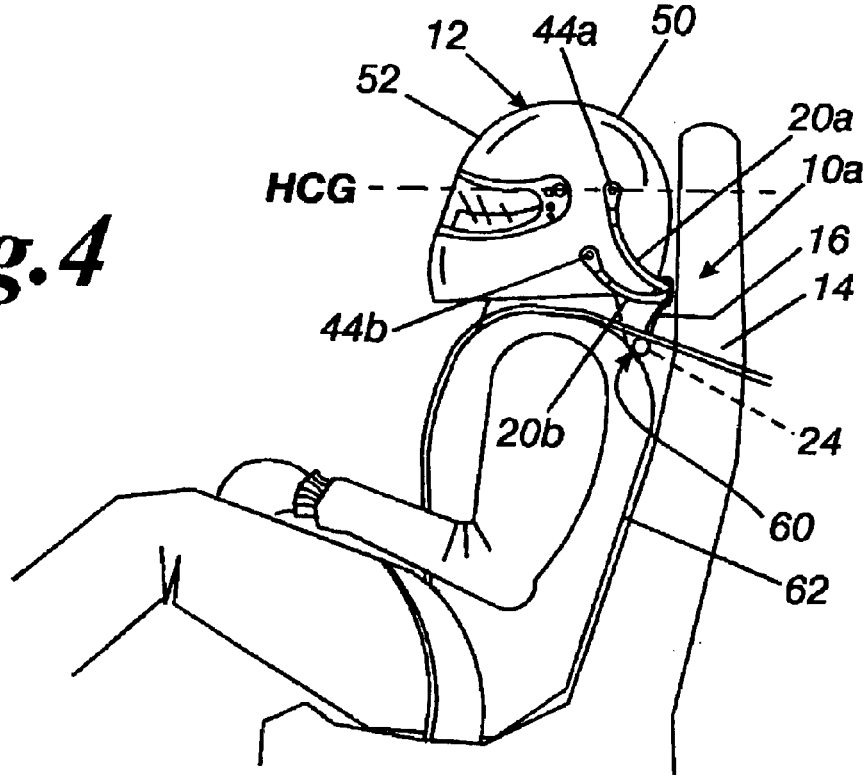
FIG. 4 is a side view of the helmet restraint device of FIG. 3.
Figure 5:
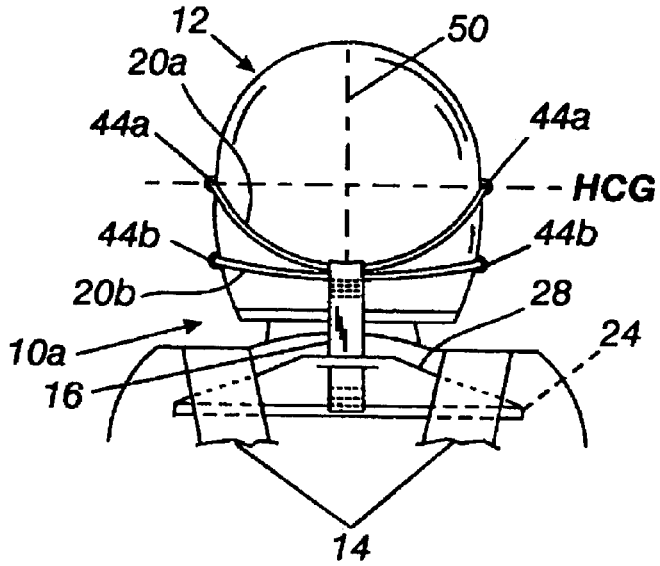
FIG. 5 is a rear view of the helmet restraint device of FIG. 3.

FIGS. 3 through 5 show an alternative embodiment of the helmet restraint device 10*a*, similar to the previously described embodiment. Like elements are identically numbered while similar elements are distinguished by an (a) or (b) following the reference number. The alternative embodiment includes a pair of cable assemblies 20*a*, 20*b* and thus having four attachment points 44*a*, 44*b* securing the restraint device 10*a* to the helmet 12. By having two cable assemblies 20*a*, 20*b*, additional control of the driver's head and neck is gained during a collision. The attachment points 44*a*, 44*b* are on opposed sides of the helmet 12. That is, the corresponding attachment points are equal-distantly spaced from the longitudinal center-line 50 of the helmet 12. The attachment points 44*a* from the first cable assembly 20*a* are located on opposed sides of the helmet 12 at approximately the head center of gravity (HCG). The HCG is the horizontal plane which equivalently divides the combined mass of the helmet and occupant's head when the occupant is in a normal vehicle operating position. The attachment points 44*b* for the second cable assembly 20*b* are preferably positioned lower than, and slightly forward of, the first cable assembly attachment points 44*a* The attachment points 44*a*, 44*b* are positioned so that during a collision event, a resultant force vector (V) (see FIG. 2*a*) associated with the cable assemblies 20*a*, 20*b* extends through the forehead region 52 of the occupant's helmet 12. As such, restraint forces transmitted by the helmet restraint device 10*a* impedes the occupant's head and neck from further forward and downward movement.

Figure 6:
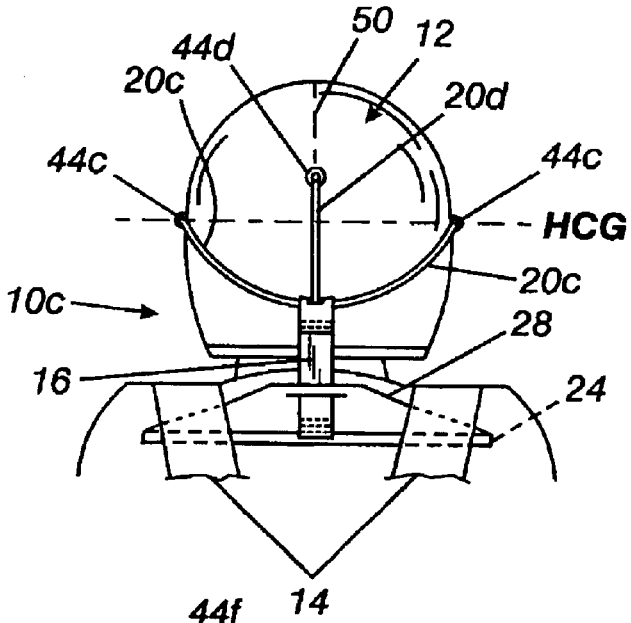
FIG. 6 is a rear view of a second alternative embodiment of the helmet restraint device showing three attachment points between the restraint device and a helmet.

FIG. 6 shows another alternative of the helmet restraint device 10*b*, similar to the previously described embodiments, but having two cable assemblies 20*c*, 20*d* providing three attachment points 44*c*, 44*d* to the helmet 12. The attachment points 44*c* of the first cable assembly 20*c* are formed as previously described and are positioned on opposed sides of the helmet 12 approximately at the horizontal plane defining the head center of gravity (HCG). The second cable assembly 20*d* has a first end attached to the mid-point of the first cable assembly 20*c*, or to the strap 16, and a second end having an attachment point 44*d* above the head center of gravity (HCG) along the center-line 50 of the helmet 12. The location of the attachment points 44*c*, 44*d* on the helmet 12, as with the previously described embodiments, creates a resultant force vector (V) (see FIG. 2*a*) through the forehead region of the occupant's helmet 12 when the strap 16 is put into tension. Accordingly, the helmet 12 is restrained from continued forward and downward movement.

The position and number of attachments between the helmet restraint device and the helmet is not limited by the shown embodiments. Regardless of the number of attachment points, the attachment points are preferably arranged such that a resulting force vector (V) caused by the helmet restraint device during a collision, extends to the forehead region of the occupant's helmet. Moreover, by position attachment points on opposed sides of the helmet, the helmet restraint device provides support to the occupant's head and neck against sideways forces that may be caused during a collision.

Figure 7:
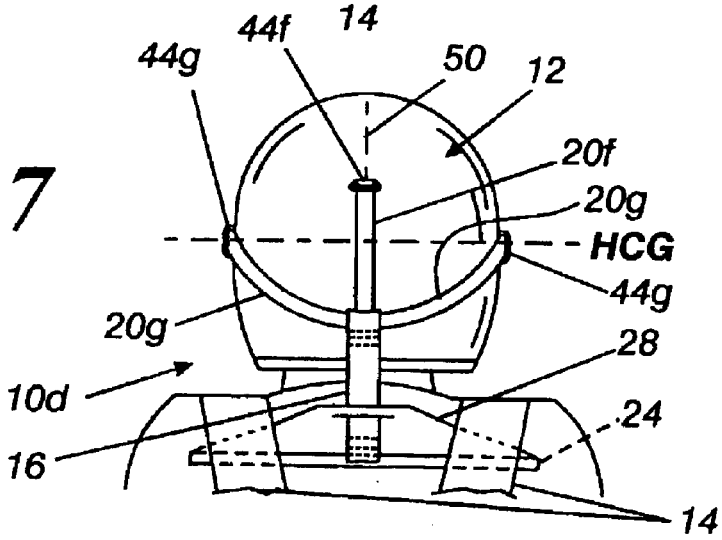
FIG. 7 is a rear view of a third alternative embodiment of the helmet restraint device, similar to FIG. 6, but having tethers and D-clips to attach the restraint device to a helmet.

Furthermore, the previously described cable assemblies and attachment means to the helmet are exemplary, and not exhaustive. As a further example, the helmet restraint device 10*g* shown by FIG. 7 is similar to the embodiment illustrated by FIG. 6, except that tethers 20*f*, 20*g*, which tie to mounted D-clips 44*f*, 44*g*, are used instead of cable assemblies.

As another option, to assist in keeping the rod 24 in properly positioned beneath the shoulder belts 14 through normal use and in event of a collision, releasable attachment means 60 may be provided to temporarily attach the fire retardant cloth 28 to the shoulder area of the occupant's racing suit 62, as shown in FIGS. 3 and 4. For example, seperable hook and loop fasteners such as Velcro, tape, or other means can be complementary positioned on the fire retardant cloth 28 and the occupant's suit 62. Where the helmet restraint device 10 does not include a fire retardant cloth 28, the temporary attachment means 60 can be complementarily positioned on the strap 16 and occupant's suit 62. Although the releaseable attachment means 60 is illustrated only in FIG. 3 and 4, it can equally be used with any of the other embodiments disclosed herein.

Various other suitable options to keep the helmet restraint device 10 properly positioned with respect to the occupant, particularly the high strength lightweight rod 24, are within the scope of the invention. For example (not shown), the rod can be releaseably retained by a small padded pouch fixed to the occupant's racing suit or to the underside of the shoulder harness. In the event of a collision, the rod escapes from the pouch and loads against the shoulder belts, controlling the motion of the bead and neck. In a further example, the terminal ends of the rod can be provided with grooves which accommodate and slidably move among the shoulder belts.

In operation and referring to FIG. 1, the helmet restraint device 10 of the present invention is small, unintrusive, lightweight and easy to handle which enables the occupant to wear the device with little to no interference between the helmet restraint device 10 and the helmet 12 and the shoulder area of the occupant. The compactness and lightweight features of the invented device 10 do not interfere with the occupant's mobility while operating the vehicle, allowing unobstructed side-to-side movement of the occupant's head, and allows the occupant to wear the helmet restraint device 10 while entering and exiting the vehicle.

The helmet restraint device 10 is attached to the helmet 12 prior to the occupant entering the vehicle. Once seated in the vehicle, the rod 24 is positioned beneath the shoulder belts 14 of the seatbelt assembly. Optionally, the restraint device 10 is releasably attached to the racing suit 62 via complementary hook and loop fasteners 60 (FIG. 3). As illustrated in FIG. 2*a*, upon a high deceleration event, such as a frontal collision, the high strength, lightweight rod 24 and strap 16 are carried forward with the occupant (relative to the vehicle seat). At the point in the collision event that the head and neck begin to rotate and move ahead of the torso, the rod 24 reacts and loads against the shoulder belts 16.

The shoulder belts 14 apply downward and rearward loads on the load bearing surfaces on the rod 24. These counteracting forces are transmitted through the helmet restraint device 10 to cause a resultant force vector (V) which extends through the forehead region 52 of the helmet 12 towards the back of the helmet 12 to resist the forward and downward rotational motions of the occupant's head and helmet 12, relative to the occupant's torso. Accordingly, loads which would otherwise be transferred through the occupant's neck and cause injury or death are instead substantially resolved by the helmet restraint device 10.

Since the rod 24 is not affixed to any portion of the vehicle, the occupant can quickly egress the vehicle by simply releasing the standard seatbelt assembly provided with the vehicle. Moreover, since the helmet restraint device 10 is small and unintrusive, it does not impede the occupant's egress from the vehicle. This is particularly important during an emergency situation.

SUMMARY OF THE ACHIEVEMENT OF THE OBJECTS OF THE INVENTION

From the foregoing, it is readily apparent that 1 have invented an improved method and apparatus for controlling the head and neck of an occupant while operating a high performance vehicle, particularly during a frontal collision. In particular, the helmet restraint device is configured to resist forward and downward movement of the occupant's head and helmet during a deceleration event. Furthermore, the device is small and unintrusive such that it does not interfere with, or cause discomfort to, the occupant while operating the vehicle. Furthermore, the device is not affixed to any portion of the vehicle, and therefore does not impede the occupant's egress from the vehicle, which is essential during an emergency situation.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. A helmet restraint apparatus for restraining the forward and downward movement of an occupant's helmet and head during deceleration of a vehicle, comprising:

a flexible member having a first section and a second section;

an attachment member engaged with the first section and adapted for being attached to the helmet; and a rigid member engaged with the second section and adapted for being disposed beneath shoulder belts of the vehicle;

wherein said rigid member is movable relative to the shoulder belts and loads against the shoulder belts during deceleration of the vehicle; and wherein said flexible member is moveable along said attachment member.

2. The restraint apparatus according to claim 1 wherein said attachment member is adapted for being attached to the helmet at a plurality of locations.

3. The restraint apparatus according to claim 2 wherein said attachment member is adapted for being attached to the helmet at three locations wherein one of the locations is at the back of the helmet along a longitudinal center-line of the helmet and the other two locations are on opposed sides of the helmet.

4. The restraint apparatus according to claim 1 wherein said helmet restraint device causes a resultant force vector to occur through the forehead region of the helmet during deceleration of the vehicle.

5. The restraint apparatus according to claim 1 further including a fire retardant cloth attached to said rigid member and positionable over the neck of the occupant.

6. The restraint apparatus according to claim 1 wherein said restraint device is adapted to be attached to a clothing item of the occupant.

7. The restraint apparatus according to claim 6 further including a fire retardant cloth engaged with said flexible member and wherein said cloth is for being releasably attachable to the clothing item.

8. The restraint apparatus according to claim 7 wherein said flexible member includes means for adjusting the length of said flexible member.

9. A method for resisting downward and forward motion of an occupant's helmet and head during deceleration of a vehicle, comprising the steps of:

providing a helmet restraint device having a rigid member, a first member engaged with said rigid member, and an attachment member engaged with said first member;

positioning said rigid member behind the occupant and beneath shoulder belts of the vehicle;

moving said rigid member relative to the shoulder belts when the vehicle is decelerated;

loading said rigid member against the shoulder belts and not against the front portion of the occupant's torso;

placing said first member in tension; and restraining the forward and downward movement of the occupant's head and helmet.

10. The method according to claim 9 further comprising the step of loading said rigid member against an underside of the shoulder belts.

11. The method according to claim 9 further including the step of positioning the entirety said rigid member behind the occupant.

12. The method according to claim 9 further including the step of positioning said rigid member behind the occupant's neck or shoulders.

13. The method according to claim 9 further including the step of loading said rigid member only against the shoulder belts when the vehicle is decelerated.

14. The method according to claim 10 wherein said first member is moveable along said attachment member.

15. A helmet restraint apparatus for restraining forward and downward movement of an occupant's helmet and head during deceleration of a vehicle, comprising:

a first member;

an attachment member engaged with said first member and adapted for being attached to the helmet; and a rigid member engaged with said first member and adapted for being disposed beneath shoulder belts of the vehicle and behind the occupant, wherein said rigid member loads against the shoulder belts and not against the front portion of the occupant's torso during deceleration of the vehicle.

16. The restraint apparatus according to claim 15 wherein said rigid member does not load against any portion of the occupant during deceleration of the vehicle.

17. The restraint apparatus according to claim 15 wherein said rigid member is adapted to load only against the shoulder belts during deceleration of the vehicle.

18. The restraint apparatus according to claim 15 wherein the entirety of said rigid member is adapted for being disposed behind the occupant.

19. The restraint apparatus according to claim 15 wherein the entirety of said rigid member is adapted for being disposed behind the occupant's neck or shoulders.

20. The restraint apparatus according to claim 15 wherein said first member is moveable along said attachment member.

* * * * *